US011495872B2

(12) United States Patent
Ojha et al.

(10) Patent No.: US 11,495,872 B2
(45) **Date of Patent: *Nov. 8, 2022**

(54) SINGLE POINT HEAVY DUTY MONOPOLE PLATFORM

(71) Applicant: CommScope Technologies LLC, Hickory, NC (US)

(72) Inventors: Jyoti Ojha, Euless, TX (US); Dale Richard Heath, Fort Worth, TX (US); Raphael J. de La Soujeole, Irving, TX (US); Firoz Ahmed, Irving, TX (US); Robert Campbell, Irving, TX (US)

(73) Assignee: CommScope Technologies LLC, Hickory, NC (US)

( * ) Notice: Subject to any disclaimer, the term of this patent is extended or adjusted under 35 U.S.C. 154(b) by 120 days.

This patent is subject to a terminal disclaimer.

(21) Appl. No.: 16/914,952

(22) Filed: Jun. 29, 2020

(65) Prior Publication Data

US 2021/0005950 A1 Jan. 7, 2021

Related U.S. Application Data

(60) Provisional application No. 62/870,327, filed on Jul. 3, 2019.

(51) Int. Cl.
*H01Q 1/12* (2006.01)

(52) U.S. Cl.
CPC ..... *H01Q 1/1228* (2013.01); *H01Q 1/1242* (2013.01)

(58) Field of Classification Search
CPC ..... H01Q 1/1228; H01Q 1/1242
See application file for complete search history.

(56) References Cited

U.S. PATENT DOCUMENTS

2011/0279347 A1* 11/2011 Pass ..... E04G 3/243 343/890
2012/0080655 A1* 4/2012 Coffin ..... E04G 21/3204 29/525.01
2020/0194884 A1* 6/2020 Clifford ..... H01Q 3/08

FOREIGN PATENT DOCUMENTS

KR 20160084707 * 1/2015
WO WO-2010149140 A1 * 12/2010 ..... F41H 5/26

* cited by examiner

*Primary Examiner* — Awat M Salih
(74) *Attorney, Agent, or Firm* — Myers Bigel, P.A.

(57) ABSTRACT

The present disclosure is directed to a brace for a mounting frame typically used for mounting antennas to a monopole tower. The brace may include a standoff connection comprising a first standoff bracket and a second standoff bracket; a first angled member attached to the first standoff bracket at a lower end of the first angled member, the first angled member also including a first handrail connector at an upper end of the first angled member; a second angled member attached to the second standoff bracket at a lower end of the second angled member, the second angled member also including a second handrail connector at an upper end of the second angled member; and a crossmember disposed between the upper end of the first angled member and the upper end of the second angled member.

19 Claims, 10 Drawing Sheets

SINGLE POINT HEAVY DUTY MONOPOLE PLATFORM

RELATED APPLICATION

This application claims priority from and the benefit of U.S. Provisional Patent Application No. 62/870,327, filed Jul. 3, 2019, the disclosure of which is hereby incorporated herein by reference in its entirety.

FIELD OF THE INVENTION

The present application is directed generally toward telecommunications equipment and more particularly high capacity monopole platforms.

BACKGROUND OF THE INVENTION

Various types of towers have been constructed for the purpose of supporting one or more antennas, such as those for broadcasting television and radio signals. Some towers are specifically designed for transmitting and receiving cellular telephone signals and other types of radio frequency (RF) signals. As wireless data service demands have grown, a conventional response has been to increase the number and capacity of conventional cellular Base Stations (Macro-Cells). Such Macro-Cells are typically mounted on antenna towers. A conventional antenna tower has three or four legs on which antennas and supporting remote radio units (RRUs) are mounted. However, in some environments, structures known as "monopoles" are used as mounting structures. A typical monopole antenna tower 100 is shown in FIG. 1 having a central pole 101 on which a mounting frame 103 attaches to hold antennas 105. Monopoles are typically employed when fewer antennas/RRUs are to be mounted and/or when a structure of less height is required.

RF towers (including monopoles) are often designed to allow a person to climb to a position along the height of the tower and remain there to install and/or repair RF antennas (e.g., cellular antennas) and other equipment connected to the tower. Mounting frames are typically mounted near the tops of RF towers (e.g., cellular towers) and may include platforms for supporting workers who may be responsible for installing and/or maintaining RF antennas (e.g., cellular antennas). Such platforms are designed to support the weight of a human and may also be used to support a number of the RF antennas. Exemplary platforms are described in U.S. Pre-Grant Publication No. 2011/0279347 to Pass et al., the disclosure of which is hereby incorporated herein in its entirety. The platform described in Pass et al. is a so-called "six-sector" platform.

Typically, one of the limiting factors of mounting frames is the vertical load capability, especially for frames which attach to the monopole at a single point (i.e., at a single vertical location using a single collar). To increase the load capacity of the frame, some known designs support the frame with standoff arms forming a truss structure, which may require significant welding or produce significant waste material, especially if the standoff arm is cut out of a solid sheet or plate. Other designs use gussets, one on each side of the standoff arms, which can increase manufacturing time and cost and can result in a cavity where water can pool. There may be a need for a mounting frame that allows for easy fabrication and more efficient installation while reducing manufacturing costs.

SUMMARY

As a first aspect, embodiments of the present disclosure are directed to a brace for a mounting frame. The brace may comprise a standoff connection which includes a first standoff bracket and a second standoff bracket. The brace may also comprise a first angled member attached to the first standoff bracket at a lower end of the first angled member. The brace may also comprise a second angled member attached to the second standoff bracket at a lower end of the second angled member. The first angled member may also include a first handrail connector at an upper end of the first angled member. The second angled member may also include a second handrail connector at an upper end of the second angled member. The brace may also include a crossmember disposed between the upper end of the first angled member and the upper end of the second angled member.

As a second aspect, embodiments of the present disclosure are directed to a mounting frame containing a brace as described herein.

As a third aspect, embodiments of the present disclosure are directed to a method for bracing a mounting frame including the step of attaching a brace as described herein to a mounting frame.

DETAILED DESCRIPTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the below description is for the purpose of describing particular embodiments only and is not intended to be limiting of the invention. As used in this disclosure, the singular forms "a", "an", and "the" are intended to include the plural forms as well, unless the context clearly indicates otherwise. It will also be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Figure 1:
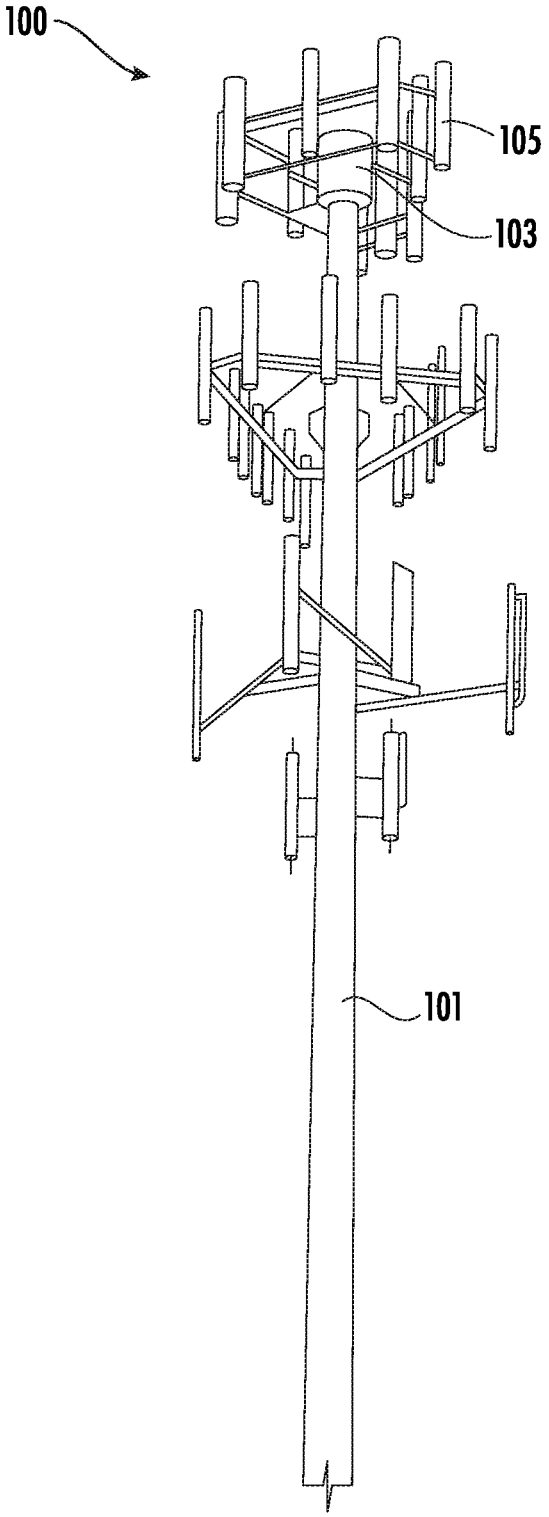
FIG. 1 is a front perspective view of a monopole tower.
Figure 2:
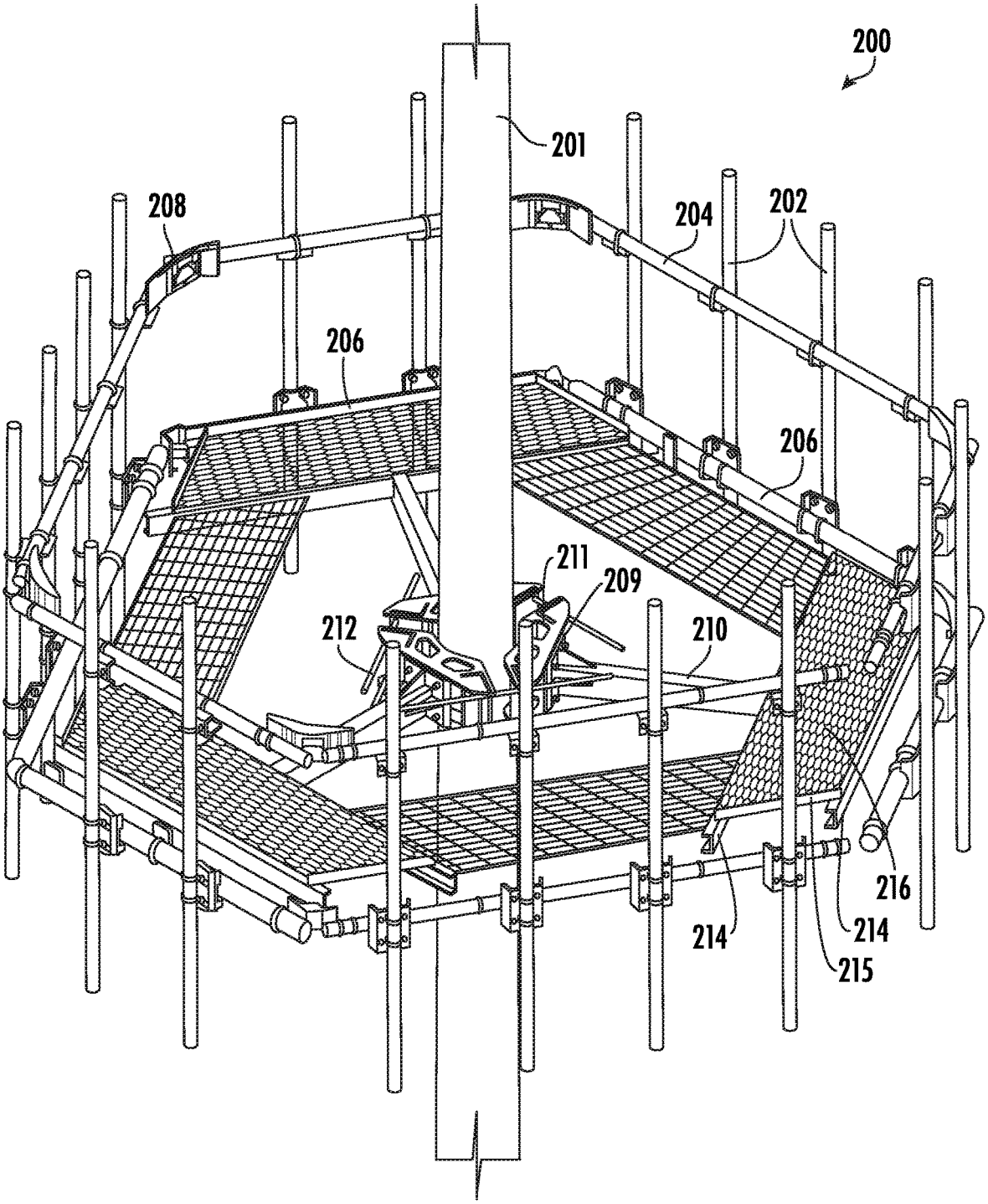
FIG. 2 is a front perspective view of a mounting frame according to one embodiment of the present disclosure.

Referring now to FIG. 2, a mounting frame assembly 200 is shown. The mounting frame assembly 200 includes antenna pipes 202 on which radio or other electronic equipment may be mounted (e.g., as shown in FIG. 1). The antenna pipes 202 are attached to an upper face pipe 204 and a lower face pipe 206. The upper face pipe 204 may also serve as a handrail 204. In general, the handrails 204 and face pipes 206 are arranged to form a generally polygonal perimeter, although circular or elliptical arrangements are contemplated. In some embodiments, the perimeter forms from about 3 to about 10 faces, or sectors (e.g., the depiction of mounting frame assembly 200 has six sectors in FIG. 2). Six-sector platforms are described in U.S. application Ser. No. 16/404,672 to Palmer et al., the disclosure of which is hereby incorporated herein in its entirety, and U.S. Provisional Application No. 62/749,421 to de La Soujeole, the disclosure of which is also hereby incorporated herein in its entirety. In some embodiments, adjacent sections of the handrail 204 may be joined together with a handrail tie 208.

The mounting frame assembly 200 may be attached to the pole 201 in a single-point arrangement. For instance, the mounting frame assembly 200 may comprise standoffs 210 which extend radially from the perimeter of the mounting frame assembly 200 to attach to a monopole 201. In some embodiments, the standoffs 210 may terminate in a standoff flange 209 for attachment to a collar mount segment 211. Collar mount segments 211 may be joined together (e.g., by threaded rods 212) to encircle the pole 201 for securing the mounting frame assembly 200.

In some embodiments, a standoff 210 may terminate at a first end with a standoff flange 209 and may also include a second end forming at least part of a platform assembly. A platform assembly according to some embodiments may comprise a frame 214 with at least two grating edge members 215 to hold a grating 216. In some embodiments, the platform assembly is formed of a weldment. In some embodiments, the platform assembly may comprise galvanized steel members. The grating 216 may have a trapezoidal shape as shown or may be configured in any other shape depending on the design of the frame 214 of the platform assembly. The grating 216 may be configured as a steel mesh or other material having sufficient strength to support a technician and providing good traction to minimize slippage.

In some embodiments, the standoff 210 comprises an elongated, hollow main tube with a rectangular cross-section. The standoff 210 may have a length, a width, and a height. In some embodiments, the standoff 210 has a length in the range of about 40 inches to about 60 inches. In some embodiments, the standoff 210 has a width in the range of about 2 inches to about 6 inches. In some embodiments, the standoff 210 has a height in the range of about 4 inches to about 10 inches. In some embodiments, the standoff 210 has a height that is greater than its width. For example, in some embodiments, the standoff 210 has height in the range of about 4 inches to about 8 inches combined with a width in the range of about 2 inches to about 4 inches. In some embodiments, the standoff 210 has a height-to-width ratio of from about 2:1 to about 3:1.

Unlike known platforms or standoffs that have square or round support members, the standoff 210 may employ a rectangular tube having a greater height to width ratio than the platforms or standoffs in the prior art. This arrangement allows the standoff 210 to support heavier vertical load weights than prior standoffs of similar weight and/or to support the same vertical loads with lighter support members that use less material. For example, standoffs 210 of the present disclosure may not require gussets or other reinforcements which add material and weight to the standoff 210. For instance, a standoff 210 having a rectangular cross-section may have a higher second moment of inertia about a neutral horizontal axis than a square standoff 210 having the same cross-sectional area, weight per foot, and/or tubular wall thickness. Increasing the height of a rectangular standoff 210 thereby increases the resistance of the standoff 210 to bending in a direction perpendicular to the horizontal neutral axis (i.e., stiffness in a vertical direction). In some embodiments, the high capacity platform assembly is configured to support a load weight of from about 100 pounds to about 1200 pounds per antenna pipe, and in some embodiments, the platform assembly and/or the standoff 210 may support from 2 to 6 antenna pipes. In some embodiments, the mounting frame assembly 200 is configured to support from about 400 pounds to about 4800 pounds per sector. In some embodiments, the mounting frame 200 may support from about 1200 to about 14400 pounds (e.g., for a three-sector mounting frame) or to about 28800 pounds (e.g., for a six-sector mounting frame, such as mounting frame 200 shown in FIG. 2).

Figure 3:
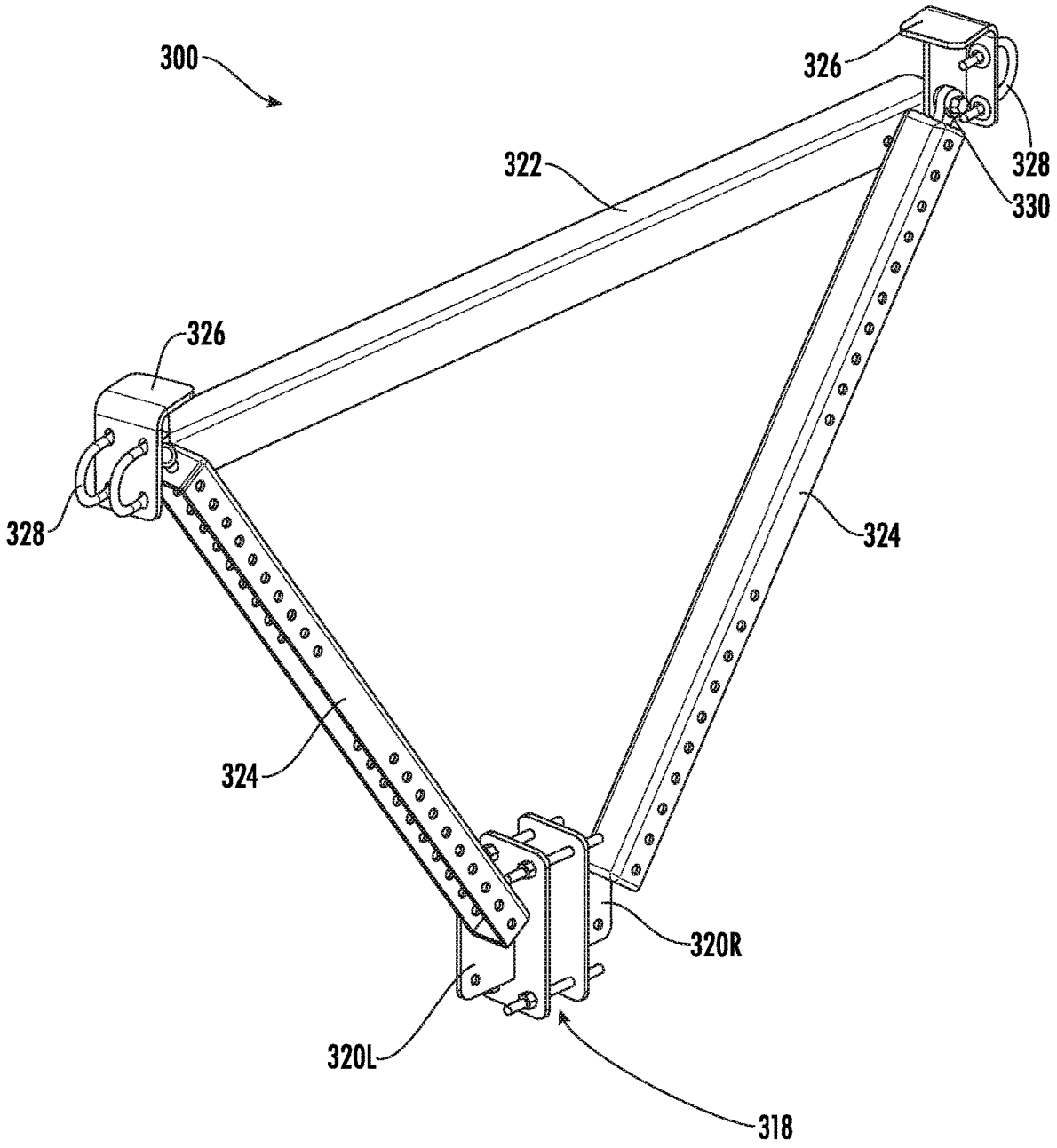
FIG. 3 is a front perspective view of a brace according to one embodiment of the present disclosure.

In some embodiments, the mounting frame assembly 200 may include a brace 300, as shown in FIG. 3. The brace 300 may generally include a crossmember 322 and two angled members 324. The crossmember 322 may span the brace 300 between two handrail connectors 326, which may connect the brace 300 to a pair of handrails 204, such as with a bracket secured by U-bolts 328. In one embodiment, the angled members 324 may attach to the crossmember 322 and the crossmember 322 may attach to the handrail connectors 326. Alternatively, the crossmember 322 may attach to the angled members 324 (e.g., at an upper end thereof), each of which then attach to the handrail connectors 326, as shown in FIG. 3. In some embodiments, the crossmember 322 and the angled members 324 independently attach to the handrail connectors 326.

In some embodiments, the angled members 324 and the crossmember 322 are formed of the same material and/or components. In some embodiments, the angled members 324 and/or the crossmember 322 are formed of a pipe, tube, open channel or bar, folded sheet metal, or a weldment.

Figure 4:
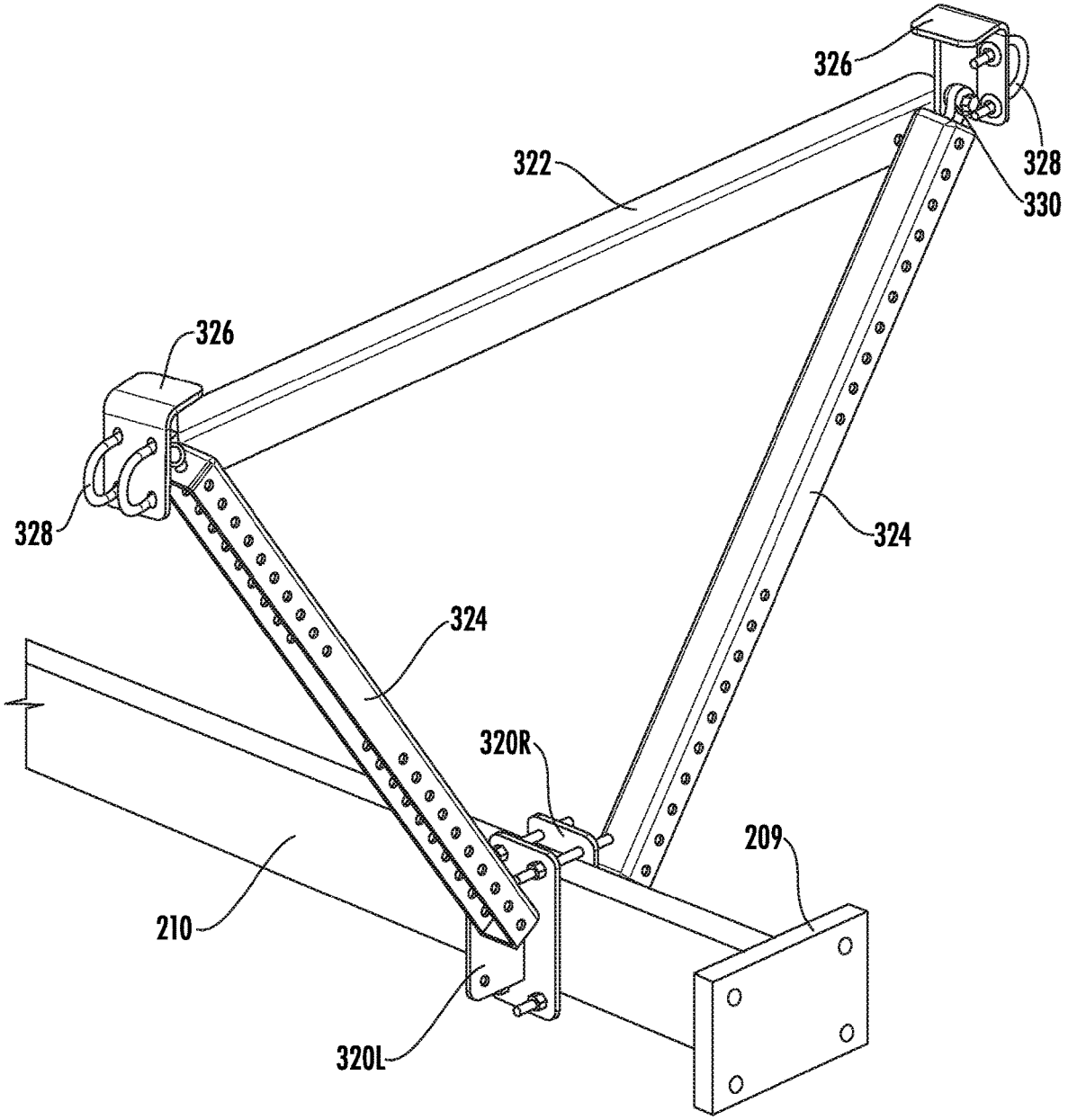
FIG. 4 is a front perspective view of the brace of FIG. 3 attached to a standoff.

Some embodiments of a brace 300 may include a standoff connection 318. The standoff connection 318 may include standoff brackets 320R and 320L for attachment to a standoff 210. A standoff connection 318 may attach to substantially any standoff 210 having any cross-sectional shape (e.g., square, circular, rectangular, or otherwise). For instance, the two standoff brackets 320R and 320L may cooperatively close around and clamp onto the tube body of a standoff 210, as shown in FIG. 4. The lower ends of the angled members 324 may be bolted, welded, or otherwise attached or joined to at least one of the standoff brackets 320R and 320L.

Figure 5:
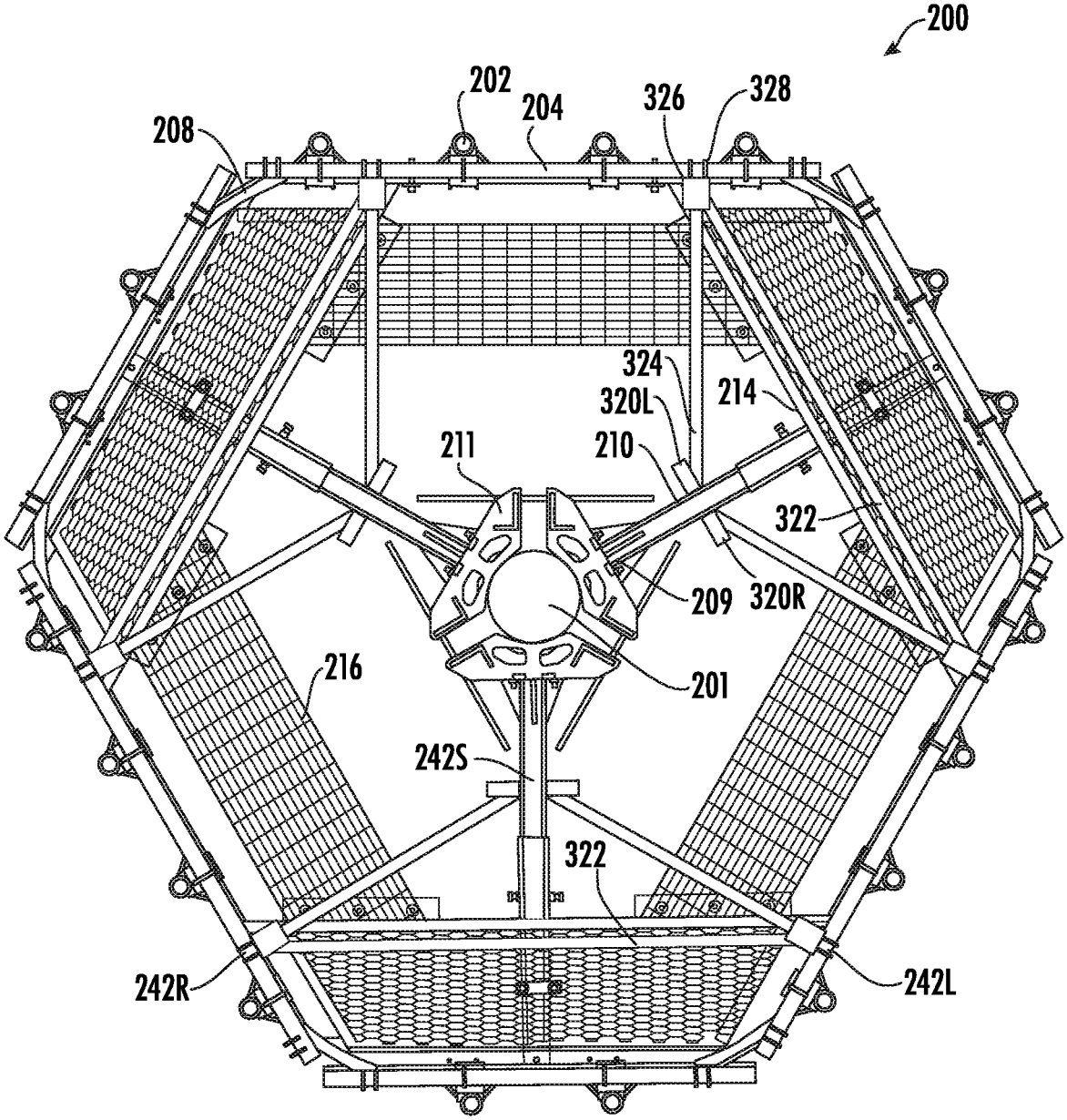
FIG. 5 is an overhead view of the mounting frame of FIG. 2 having the brace of FIG. 3 installed thereon.

As shown in FIG. 5, braces 300 may be installed onto an existing mounting frame assembly 200. Each crossmember 322 may tie together at least two points of the perimeter formed by the handrails 204, such as the points 242L and 242R on a first handrail portion and a second handrail portion, respectively. Additionally, the standoff brackets 320R and 320L may surround and clamp onto the standoff 210, anchoring the angled members 324 to the standoff 210 and tying the standoff 210 to the handrail 204. In this manner, a triangular or V-shaped brace 300 may be formed between the handrails 204 and the standoff 210. In some embodiments, the standoff connection 318, which may include the standoff brackets 320R and 320L, may be disposed along the standoff 210 at a position 242S between the platform frame 214 and the standoff flange 209. The position 242S of the standoff connection 318 (e.g., including brackets 320R and 320L) may be spaced in front or in back of the handrail connectors 326 (e.g., spaced in front as shown) so that the angled members 324 form a tilted triangular or V-shaped profile. The distance between the point of contact with the angled braces 324 (e.g., at a standoff connection 318 at a position 242S) and the collar mount segment 211 may vary. For instance, the point of contact with the angled braces 324 may be nearby or even adjacent to the standoff flange 209, nearby or even adjacent to the platform frame 214, and/or at any position therebetween.

Figure 6:
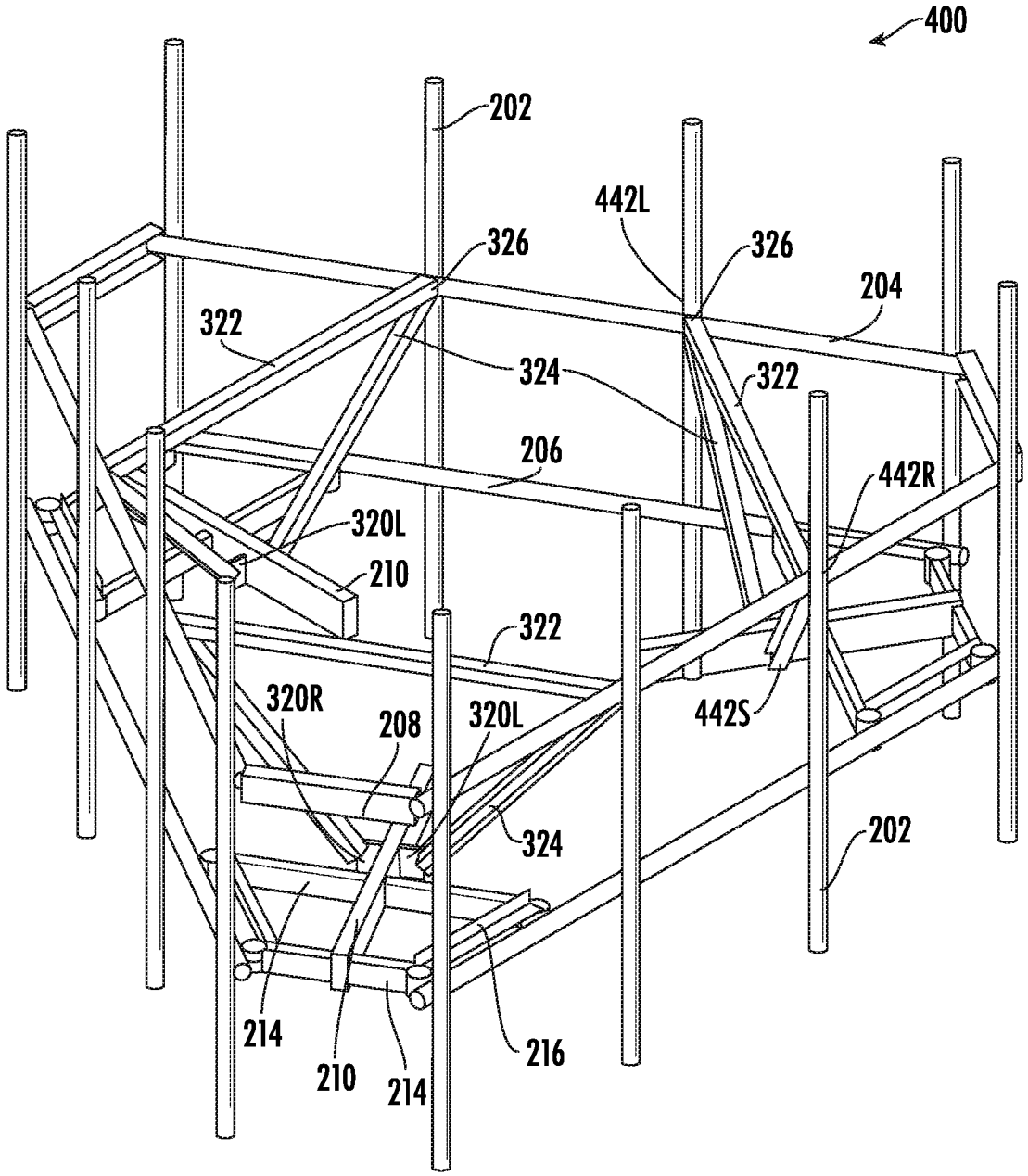
FIG. 6 is a front perspective view of a mounting frame according to another embodiment of the present disclosure having a brace installed thereon.
Figure 7:
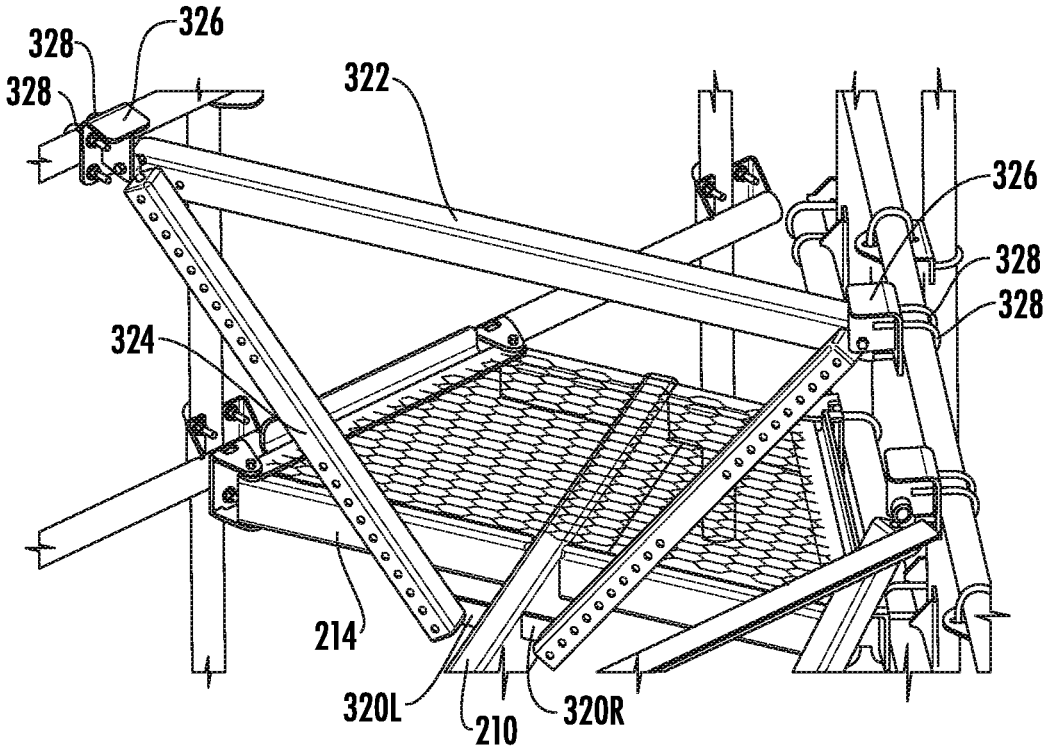
FIG. 7 is a partial perspective view of a mounting frame according to an additional embodiment of the present disclosure having a brace installed thereon.
Figure 8:
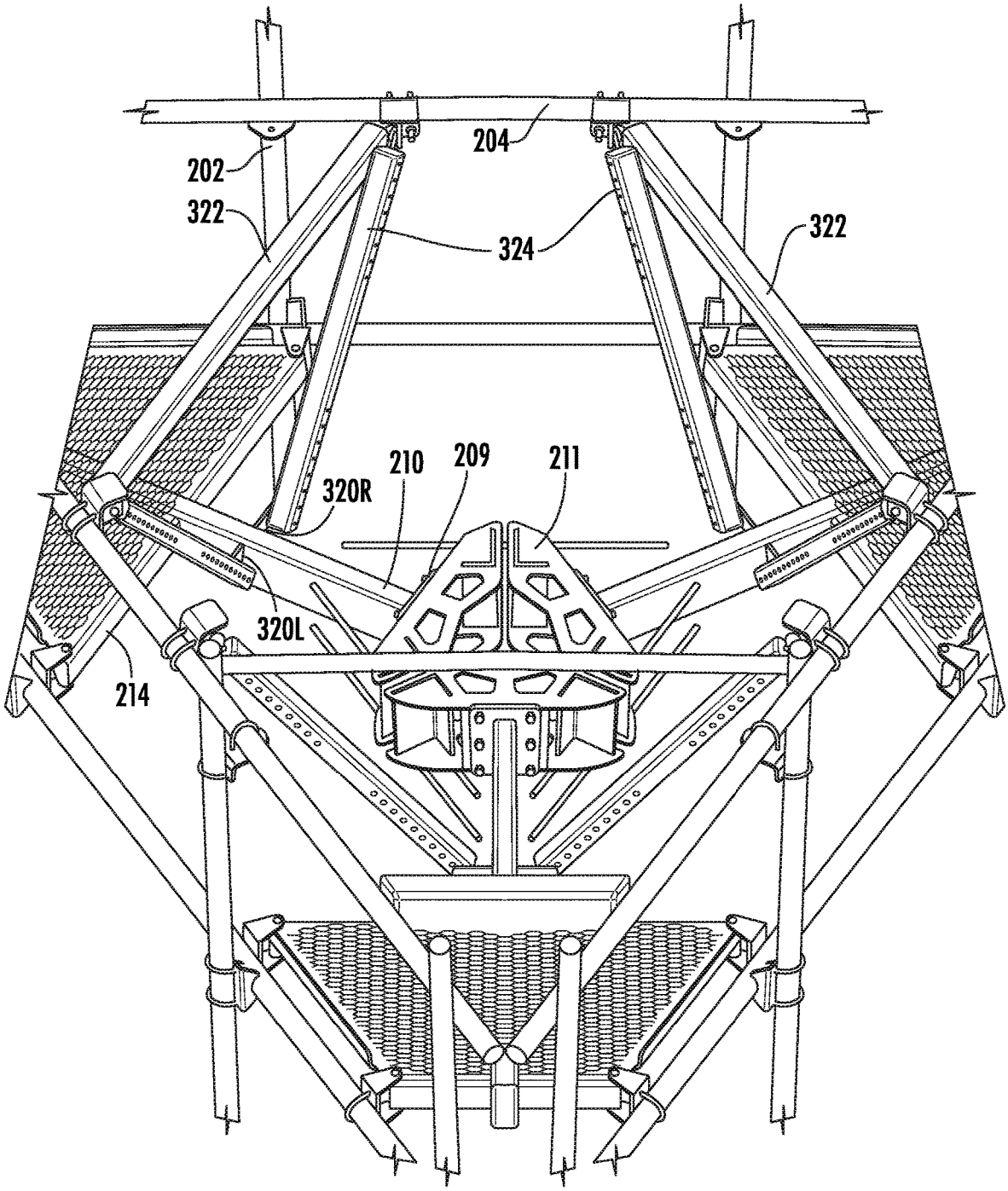
FIG. 8 is a partial perspective view of the mounting frame of FIG. 7.

Referring to FIG. 6, in one embodiment, a three-sector mounting frame assembly 400 may include standoff brackets 320R and 320L which are substantially underneath the position of the handrail connectors 326 (e.g., at a position 442S with respect to points 442R and 442L) such that the triangular or V-shaped profile formed by the angled members 324 lies in a substantially vertically oriented plane. As depicted, the standoff brackets 320R and 320L of the standoff connection 318, as depicted in FIG. 6-8, may be directly attached to standoffs 210 (e.g., by welding or bolting) or integrally formed from the standoffs 210 (e.g., by a bent tab or flange) instead of clamped around the standoffs 210. In some embodiments, the angled members 324 of the triangular or V-shaped brace 300 are directly connected to the handrails 204 and/or the standoff 210. For instance, the handrail connectors 326 may comprise a separate bracket (e.g., as in FIGS. 3-5 and 7-10) or may comprise welded joints or otherwise directly attached joints at an end of an angled member 324 and/or a crossmember 322 (as depicted in FIG. 6).

Figure 9:
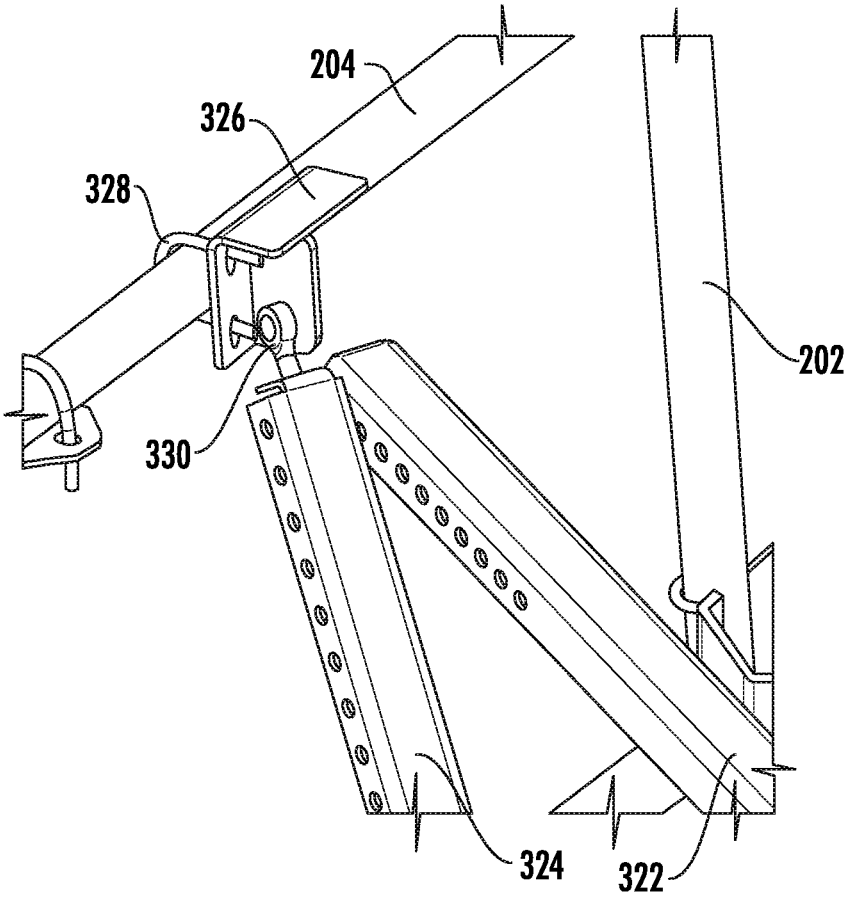
FIG. 9 is a partial perspective view of the brace of FIG. 3 attached to a mounting frame.

In some embodiments, angled members 324 (and a crossmember 322 optionally attached thereto) may connect to handrail connectors 326 using articulating joints 330 (e.g., a ball joint 330), as shown in greater detail in FIG. 9. Alternatively, or additionally, the angled members 324 may connect to the standoff connection 318 (e.g., by connecting to at least one of the standoff brackets 320R and 320L) using articulating joints 330 (e.g., a ball joint 330). In some embodiments, the angled members 324 each attach at an upper end to the handrail connector 326 with a ball joint 330. In some embodiments, the crossmember 322 attaches to the handrail connector 326 with a ball joint 330. In some embodiments, the use of a ball joint 330 to attach the angled members 324 and/or the crossmember 322 may provide a higher strength brace 300 than may be provided by a brace 300 with only non-articulating connections or fasteners between the members of the brace 300 (i.e., between the handrail connectors 326 and the angled members 324 and/or the crossmember 322).

In some embodiments, articulating joints 330 disposed between adjacent members of the brace 300 and/or portions of the mounting frame 200, 400 connecting thereto permit the adjacent members of the brace 300 to articulate with respect to one another and/or the mounting frame 200, 400. For example, when a handrail connector 326 is attached to a member of the brace 300 (e.g., a crossmember 322 or an angled member 324) with an articulating joint 330, the handrail connector 326 may articulate with respect to the member of the brace 300. If more than one handrail connector 326 is attached with an articulating joint 330, each handrail connector 326 may independently articulate.

Figure 10:
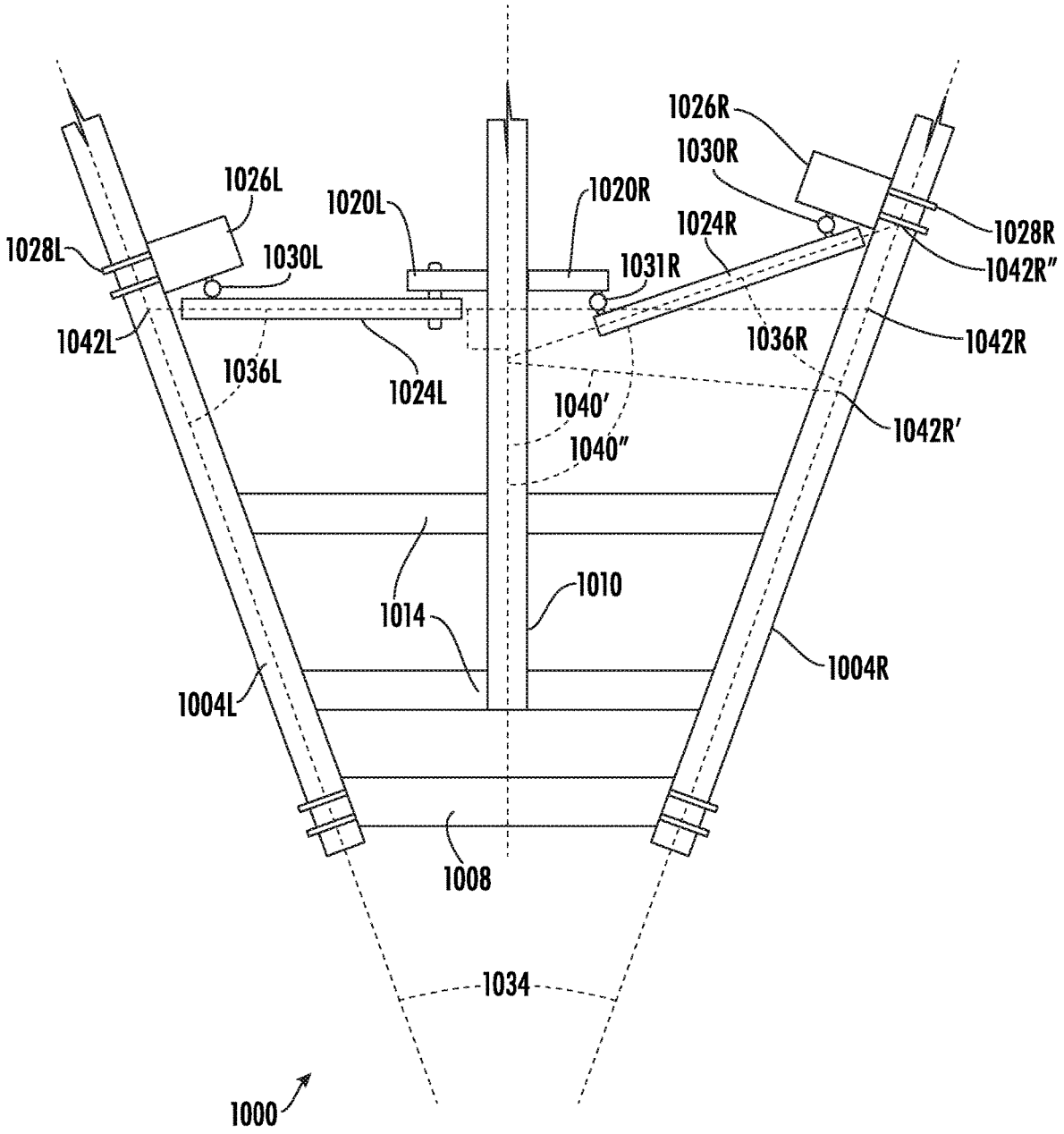
FIG. 10 is an overhead diagram of an exemplary configuration a brace installed on a mounting frame according to a further embodiment of the present disclosure.

Advantageously, attaching the angled members 324 to a handrail connector 326 and/or a standoff connection 318 with an articulating joint 330 permits the configuration of the brace 300 to a plurality of geometries optionally corresponding to different mounting frame assemblies 200, 400. For instance, FIG. 10 depicts a portion of a mounting frame assembly 1000 having a left handrail 1004L and a right handrail 1004R arranged at an included angle 1034 and connected by a handrail tie 1008. The left handrail 1004L is braced against the standoff 1010 by a left angled member 1024L. The left angled member 1024L is connected to a left handrail connector 1026L with a left ball joint 1030L and is attached to a left standoff bracket 1020L. In one embodiment, the left angled member 1024L is attached to the left standoff bracket 1020L by a bolt or other fastener which secures the left angled member 1024L against the left standoff bracket 1020L at a substantially right angle with respect to the standoff 1010 in the horizontal plane (i.e., as shown in FIG. 10). The articulating left ball joint 1030L permits the angle 1036L formed with the handrail 1004L to vary for adaptation to handrails 1004L, 1004R having a different included angle 1034.

In some embodiments, the mounting frame assembly 1000 may include angled members 1024L on both the left side and the right side. In some embodiments, the mounting frame assembly 1000 includes one or more angled members 1024R, such as the right angled member 1024R connecting the right handrail 1004R to the right standoff bracket 1020R on the standoff 1010. As with the left angled member 1024L, the right angled member 1024R may be connected to a right handrail connector 1026R using a right upper ball joint 1030R. Additionally, the connection between the right angled member 1024R and the right standoff bracket 1020R may also include a second ball joint 1031R (i.e., a right lower ball joint 1031R), thereby enabling articulation at both ends of the right angled member 1024R. For example, the angle 1036R formed between the handrail 1004R and the right angled member 1024R and the angle 1040 formed between the right angled member 1024R and the standoff 1010 may both vary to permit free positioning of the right handrail connector 1026R along the right handrail 1004R. For instance, when the right angled member 1024R is be arranged substantially similarly to the left angled member 1024L, the position 1042R of the right handrail connector 1026R may lie along a line perpendicular to the standoff 1010 and corresponding to the position 1042L of the left handrail connector 1026L. When the angled member 1024R is oriented at an angle 1040' less than about 90 degrees, the angled member 1024R may reside closer to the platform frame 1014 and the right handrail connector 1026R may be positioned at a position 1042R' closer to, e.g., the end of the handrail 1004R corresponding to the handrail tie 1008. When the angled member 1024R is oriented at an angle 1040" greater than about 90 degrees, the angled member 1024R may reside further from the platform frame 1014 and the right handrail connector 1026R may be positioned at a position 1042R" further from, e.g., the end of the handrail 1004R corresponding to the handrail tie 1008. In conjunction with the manipulation of angle 1040, the ball joint 1030R corresponding to the right handrail connector 1026R may cooperatively adapt to permit the right handrail connector 1026R to attach to the right handrail 1004R with U-bolts 1028R across a range of angles 1036R. The length of the angled members 1024R may be selected or adjusted to obtained a desired brace geometry. In some embodiments, the mounting frame assembly 1000 may include angled members 1024R on both the left side and the right side, such as in a substantially symmetric arrangement (although asymmetric arrangements are also contemplated to selectively brace areas subject to greater loads, e.g., with heavier equipment).

The configuration permitted by a brace 300 containing one, two, three, four, or more articulating joints 330 (which may include, e.g., ball joints, universal joints, and the like) enables a brace 300 to be adapted and/or retrofit to existing mounting frame 200 installations (optionally having equipment already installed thereon), even if the mounting frames 200 were not originally configured to accept a brace 300 or attach to any angled members 324. For instance, substantially any mounting frame 200 having at least a face pipe 204 and a standoff 210 may be strengthened by the addition of angled members 324, including frames 200 using square, round, truss, and/or gusseted standoffs 210. Advantageously, the brace 300 may be installed without disturbing or otherwise altering the mounting frame 200 in place on the monopole.

Furthermore, while the above-noted examples describe the advantages of the brace 300 in a single-point mounting frame 200, the brace 300 may not be limited to only single-point applications and may also be used in mounting frames 200 connecting to monopole structures, self-supported structures, guyed towers, and the like which may optionally include kicker mounts, cage structures, or other additional support structures. In some embodiments, the addition of a brace as disclosed herein may permit a reinforcement between a mounting frame and its corresponding monopole to be removed while maintaining sufficient load capacity. For instance, after installation of a brace as disclosed herein, a non-single-point mounting frame (e.g., a mounting frame having a kicker support) may have connections between the mounting frame and its corresponding monopole removed, transforming the mounting frame into a single-point mounting frame while still maintaining a sufficient or improved load capacity. The addition of a brace 300 to any mounting frame 200 may advantageously increase its loading capability, including its resistance to dead and live loading from equipment weight, environmental loads (e.g., wind, rain, earthquakes, etc.), and/or the weight of any personnel using a platform assembly within the mounting frame 200. For instance, a mounting frame 200 with insufficient load performance for a given application may be strengthened sufficiently to achieve the desired load performance when a brace 300 is installed.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A brace for a mounting frame, comprising:

a standoff connection comprising a first standoff bracket and a second standoff bracket;

a first angled member attached to the first standoff bracket at a lower end of the first angled member, the first angled member also including a first handrail connector at an upper end of the first angled member;

a second angled member attached to the second standoff bracket at a lower end of the second angled member, the second angled member also including a second handrail connector at an upper end of the second angled member; and a crossmember disposed between the upper end of the first angled member and the upper end of the second angled member, wherein the first standoff bracket and the second standoff bracket are configured to cooperatively clamp onto a standoff.

2. The brace of claim 1, wherein the first standoff bracket and the second standoff bracket are configured to weld or bolt onto a standoff.

3. The brace of claim 1, wherein at least one of the first handrail connector and the second handrail connector comprise a bracket for attaching to a handrail of the mounting frame.

4. The brace of claim 1, wherein the first handrail connector and the second handrail connector are configured to independently articulate with respect to at least one of the first angled member, the second angled member, and the crossmember.

5. The brace of claim 1, comprising:

a first articulating joint connecting the first handrail connector to at least one of the first angled member and the crossmember; and a second articulating joint connecting the second handrail connector to at least one of the second angled member and the crossmember.

6. The brace of claim 5, comprising:

a third articulating joint connecting the first angled member to the first standoff bracket; and a fourth articulating joint connecting the second angled member to the second standoff bracket.

7. The brace of claim 1, wherein the brace is configured to assemble without welding.

8. The brace of claim 1, wherein at least one of the first angled member, the second angled member, and the crossmember is formed from a pipe.

9. The brace of claim 1, wherein at least one of the first angled member, the second angled member, and the crossmember is formed from folded sheet metal.

10. The brace of claim 1, wherein the brace is configured to retrofit an existing mounting frame.

11. A mounting frame, comprising:

the brace of claim 1;

a standoff;

a platform assembly;

a first handrail portion; and a second handrail portion;

wherein the first standoff bracket and the second standoff bracket are connected to the standoff;

wherein the first handrail connector is connected to the first handrail portion; and wherein the second handrail connector is connected to the second handrail portion.

12. The mounting frame of claim 11, wherein the standoff has a rectangular cross-sectional profile.

13. A brace for a mounting frame, comprising:

a standoff connection comprising a first standoff bracket and a second standoff bracket;

a first angled member attached to the first standoff bracket at a lower end of the first angled member, the first angled member also including a first handrail connector at an upper end of the first angled member;

a second angled member attached to the second standoff bracket at a lower end of the second angled member, the second angled member also including a second handrail connector at an upper end of the second angled member; and a crossmember disposed between the upper end of the first angled member and the upper end of the second angled member, wherein at least one of the standoff connection, the first handrail connector, and the second handrail connector is configured to articulate with respect to at least one of the first angled member, the second angled member, and the crossmember.

14. The brace of claim 13, wherein the first standoff bracket and the second standoff bracket are configured to cooperatively clamp onto a standoff.

15. The brace of claim 13, wherein the first standoff bracket and the second standoff bracket are configured to weld or bolt onto a standoff.

16. The brace of claim 13, wherein at least one of the first handrail connector and the second handrail connector comprise a bracket for attaching to a handrail of the mounting frame.

17. The brace of claim 13, wherein the first handrail connector and the second handrail connector are configured to independently articulate with respect to at least one of the first angled member, the second angled member, and the crossmember.

18. The brace of claim 13, comprising:

a first articulating joint connecting the first handrail connector to at least one of the first angled member and the crossmember; and a second articulating joint connecting the second handrail connector to at least one of the second angled member and the crossmember.

19. The brace of claim 18, comprising:

a third articulating joint connecting the first angled member to the first standoff bracket; and a fourth articulating joint connecting the second angled member to the second standoff bracket.

* * * * *